United States Patent [19]

Kloweit

[11] 3,956,828

[45] May 18, 1976

[54] STYLUS FOR SIGN-MAKING MACHINE

[76] Inventor: Kenneth R. Kloweit, 1304 Leaman Place, Rockford, Ill. 61108

[22] Filed: June 23, 1975

[21] Appl. No.: 589,148

[52] U.S. Cl. ..... 33/23 K; 33/23 H
[51] Int. Cl.[2] ..... B43L 13/10
[58] Field of Search ..... 33/23 K, 23 H, 23 C

[56] References Cited

UNITED STATES PATENTS 3,171,207 3/1965 Wormser ..... 33/23 H

*Primary Examiner*—Al Lawrence Smith
*Assistant Examiner*—Roscoe V. Parker
*Attorney, Agent, or Firm*—Wolfe, Hubbard, Leydig, Voit & Osann, Ltd.

[57] ABSTRACT

In a sign-making machine, a stylus is mounted within the free end portion of an arm carrying a router to follow a template for cutting grooves in a workpiece to produce a sign. The stylus includes a body slidably mounted in the arm for movement between extended and retracted positions with respect to the arm and a spring acts between the stylus body and the arm to urge the stylus into its extended position for engagement with the template before the router bit cuts into the workpiece as the arm is lowered from a raised position into a working position. An adjustable stop connected to the stylus abuts the arm to support the arm against sliding downwardly on the stylus below a selected distance from the tip of the stylus and is movable vertically relative to the lower end to vary the selected distance while cutting a groove in the workpiece so as to move the arm vertically and thereby adjust the position of the router to follow the surface of the workpiece.

9 Claims, 8 Drawing Figures

STYLUS FOR SIGN-MAKING MACHINE

BACKGROUND OF THE INVENTION

This invention relates to a sign-making machine generally of the type disclosed in Wormser U.S. Pat. No. 3,171,207 wherein a router is carried on an arm movable in *x* and *y* directions to cut grooves in a workpiece clamped to the frame of the machine. More particularly, the present invention relates to a stylus which is secured to the outer or free end of the arm of a machine of the foregoing type to guide movement of the arm so the router cuts the grooves in the shapes desired for the various figures of the sign. When making a figure in the sign, the lower end or tip of the stylus rides on a template which is secured to the machine adjacent one side of the frame.

SUMMARY OF THE INVENTION

The primary object of the present invention is to provide in a machine of the above general character a new and improved stylus which, in service use, greatly simplifies the process of accurately positioning the router relative to the template before cutting a groove in the workpiece. A more detailed object is to achieve the foregoing by constructing the stylus so that, as the arm is lowered from a raised position into a working position, the tip of the stylus seats against the template to position the router accurately before the router bit starts to cut into the workpiece.

An additional object of the present invention is to construct the stylus to provide for selective vertical adjustment in the position of the router when cutting a groove so the router may be moved to follow the contour of the surface of the workpiece while in light bearing contact therewith so as to enable the arm to be moved easily across the machine with the tip of the stylus in engagement with and following the configuration of the template.

The invention also resides in the novel manner of mounting the stylus to slide within the outer end portion of the arm between a projected position and a retracted position relative to the arm so that, in the projected position, the tip of the stylus is spaced from the arm a selected distance to engage with the template before the bit of the router cuts into the workpiece and, in the retracted position, the tip is spaced from the arm a distance less than the selected distance to engage the template but with the router bit cutting into the workpiece and the router in light bearing contact with the surface of the workpiece.

Still further, the invention resides in the novel construction of the stylus whereby the tip of the stylus is spring urged into its projected position, and in the novel manner of raising and lowering the arm on the stylus during routing so as to lift the router over surface obstructions in the workpiece without having to lift the stylus from the template.

These and other objects and advantages of the present invention will become more apparent from the following detailed description when taken in conjunction with the accompanying drawings.

DETAILED DESCRIPTION OF THE PREFERRED EMBODIMENT

Figure 1:
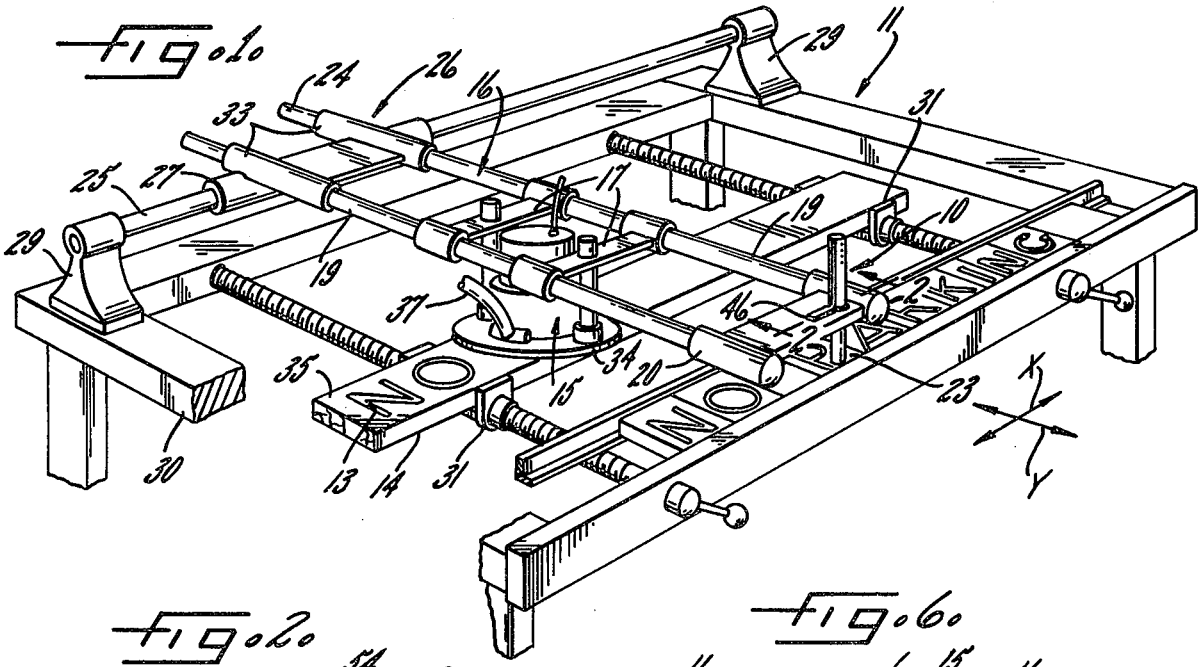
FIG. 1 is a fragmentary, perspective view of a sign-making machine equipped with a stylus embodying the novel features of the present invention.

As shown in the drawings for purposes of illustration, the present invention is embodied in a stylus 10 particularly adapted for use in a sign-making machine 11 such as is used to produce signs by cutting grooved figures 13 in a workpiece 14. One form of sign-making machine of this type is disclosed in the aforementioned Wormser Patent No. 3,171,207 and includes a router 15 (see FIG. 1) carried on an arm 16 by supports 17 extending between opposite sides 19 of the arm intermediate the ends thereof. Herein, the arm is movable in *x* and *y* directions (see arrows, FIG. 1) to carry the router over the workpiece to cut the grooves in the workpiece to form the desired figures in the sign. Connected to the outer or free end portion 20 of the arm is the stylus 10 whose lower end portion or tip 21 (see FIG. 2) rides within a template 23 disposed along the front side of the machine to guide movement of the arm for the router to cut the grooves in the workpiece. The opposite end 24 of the arm is suitably supported on an elongated rod 25 by way of a carrier 26. The latter includes a tubular slide member 27 telescoped over the rod to move in the *x* direction. Brackets 29 at opposite ends of the rod connect to the frame 30 of the machine and support the rod in an elevated position above the workpiece which, in the present instance, is secured to the frame of the machine at a fixed position relative to the template by suitable means such as clamps 31. To provide for movement in the *y* direction, the arm is movably mounted on the carrier with the opposite side members 19 of the arm being telescoped slidably through tubular bosses 33 fixed to the slide member 27.

Figure 4:
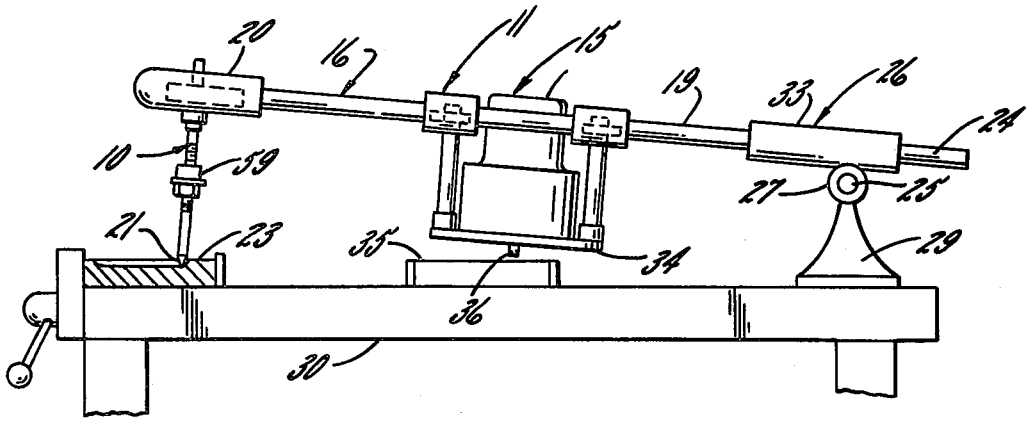
FIG. 4 is a fragmentary side elevational view of the sign-making machine showing the router-carrying arm in a raised position.
Figure 5:
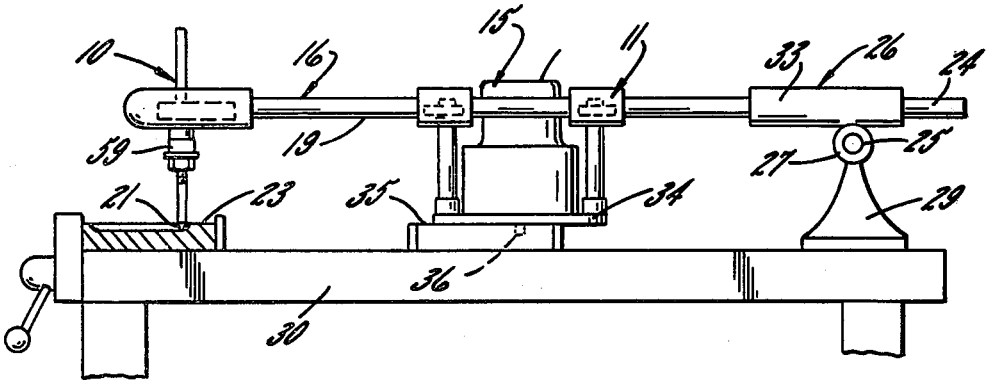
FIG. 5 is a view similar to FIG. 4 but showing the arm lowered into a working position.

In addition to movement in the *x* and *y* directions, the arm 16 also is pivotal with respect to the rod 25 to move between a raised position, such as is shown in FIG. 4, with the arm slanting upwardly and away from the rod and a working position, such as is shown in FIG. 5, with the arm extending in a generally horizontal direction. In the working position, the router 15 extends downwardly from the arm with a lower slide plate 34 engaging the upper surface 35 of the workpiece so that the cutting bit 36 of the router is positioned to cut into the workpiece to form the grooved figures 13 in the workpiece. In the present machine, the chips of material cut from the workpiece are removed from beneath the router through a vacuum hose 37 (see FIG. 1) communicating between the area adjacent the bit and a suitable vacuum source (not shown).

In accordance with the primary aspect of the present invention, the stylus 10 is constructed in a novel fashion so as to simplify the process of accurately positioning the router 15 relative to the template 23 prior to cutting into the workpiece 14. For this purpose, the stylus is mounted within the outer end portion 20 of the arm 16 to slide between extended and retracted positions with respect to said arm so that, as said arm is lowered into its working position, the tip 21 of the stylus engages with the template to locate the arm and the router precisely relative to the template before the bit 36 cuts into the workpiece. In this way, the proper lateral position of the router bit relative to the template is assured without having to estimate by eye as the arm is lowered into its working position. This is of particular advantage when cutting grooves having generally rectangular cross-sectional configurations because precise alignment of the cutting bit with respect to the template is required even when making the initial cut into the workpiece.

Figure 2:
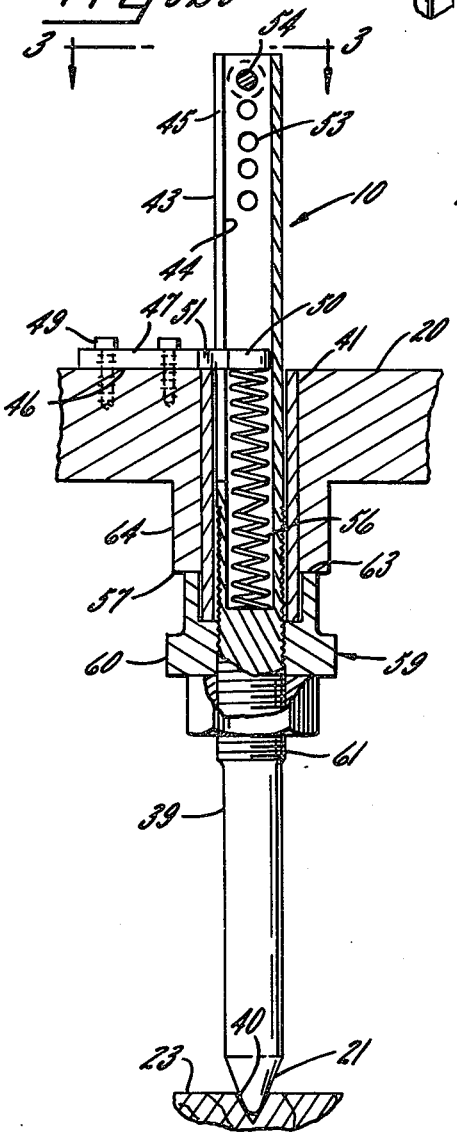
FIG. 2 is an enlarged, fragmentary, cross-sectional view taken substantially along line 2—2 of FIG. 1.

In the present instance, the stylus 10 includes a generally cylindrical body 39 with the lower tip 21 being of an inverted frusto-conical shape to ride within V-shaped grooves 40 defining the template figures. As shown in FIG. 2, the body is telescoped slidably within a cylindrical bushing 41 which extends through the free end portion 20 of the arm 16. Formed within the upper end portion 43 of the stylus is a generally cylindrical bore 44 which opens in an axial direction from the upper end of the body. In addition, an elongated slot 45 (see FIGS. 2 and 3) is formed through the side of the body and opens into the bore, the slot extending in a generally axial direction from the upper end of the body and terminating intermediate the ends of the bore.

Figure 3:
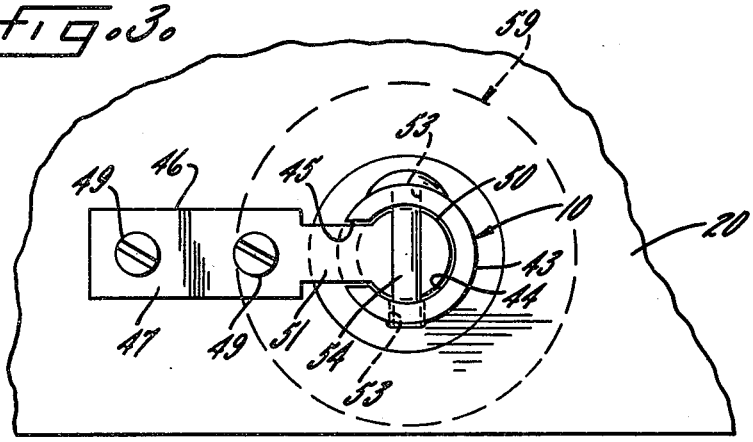
FIG. 3 is an enlarged view taken substantially along line 3—3 of FIG. 2.

To secure the stylus 10 on the arm 16, suitable means in the form of a bracket 46 includes a generally rectangular section 47 which is fastened to the arm such as by screws 49 (see FIG. 3). A circular portion 50 of the bracket fits within the bore 44 and is connected to the rectangular section by an intermediate narrow section 51 extending through the slot 45. A pair of diametrically spaced holes 53 formed through the upper end portion 43 of the body receive a pin 54 to captivate the body against sliding downwardly off the circular section of the bracket.

Figure 6:
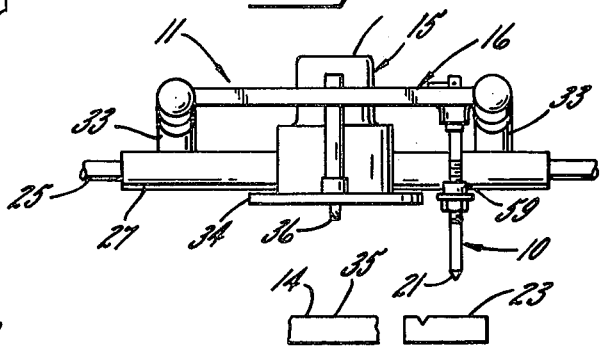
FIGS. 6, 7 and 8 are schematic front elevational views showing successive steps in initially positioning the arm of the machine for cutting a groove in a workpiece to produce a sign.
Figure 7:
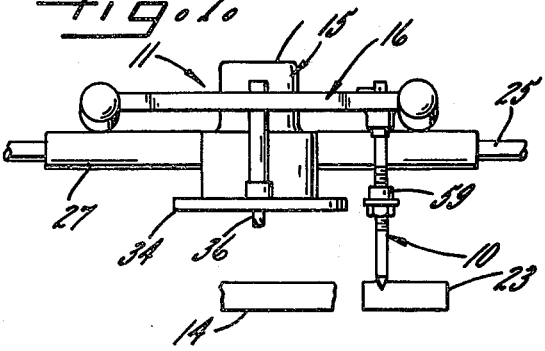
Figure 8:
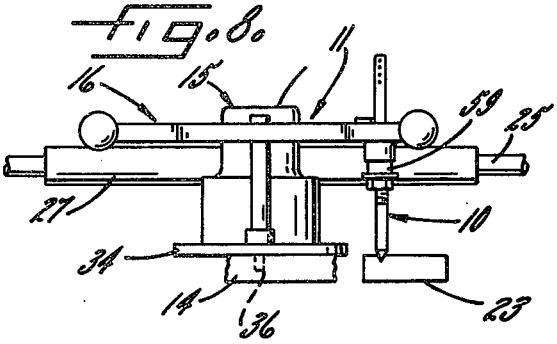

Captivated within the bore 44 between the lower end thereof and the bracket 46 is a coil spring 56 which urges the body 39 of the stylus 10 downwardly within the bushing 41. Additional vertically spaced pairs of the holes 53 in the upper end portion 43 of the stylus body provide for a coarse adjustment in the length of the body protruding downwardly from the underside 57 of the arm 16. Advantageously, the length of the stylus in its extended position is such that the portion of the body extending downwardly from the arm positions the tip 21 of the stylus below the lower end of the bit 36 so that the tip engages with the template 23 before the bit engages the upper surface 35 of the workpiece (see FIGS. 4 and 6). Accordingly, as shown in FIG. 7, the tip may be placed within the groove 40 of the template to align the arm 16 and router 15 with respect to the template prior to cutting into the workpiece with the bit so as to assure that the initial cut made in the workpiece is located accurately within the workpiece. Once the stylus tip is seated in the template groove, the arm may be slid downwardly on the body of the stylus (see FIGS. 5 and 8) to compress the spring 56 and to lower the rotating bit into the workpiece to begin cutting the groove in the workpiece.

Downward movement of the arm 16 on the stylus 10 is limited by engagement of the router slide plate 34 with the upper surface 35 of the workpiece 14 so that the arm is supported in its working position by the router 15 as it rides across the surface of the workpiece. In accordance with another important aspect of the present invention, an adjustable stop 59 is mounted on the body 39 of the stylus to engage the underside 57 of the arm and thereby aid in supporting the arm in its working position and, in addition, to provide means whereby the arm may be adjusted vertically during movement of the arm across the workpiece to keep the slide plate of the router in light bearing contact with the workpiece for easy sliding engagement with the surface thereof regardless of obstructions or contour variations in such surface. For these purposes, the stop is movable vertically on the stylus for selective adjustment of the length of the stylus body protruding downwardly from the arm. Herein, the arm is slidable freely on the body and the weight of the arm and router overcomes the spring 56 to hold the arm against the stop. Accordingly, upward movement of the stop on the body lifts the arm upwardly relative to the body while downward movement of the stop permits the arm to slide downwardly on the body. Thus, the length of the stylus projecting from the underside of the arm may be adjusted selectively to either raise or lower the horizontal position of the arm to keep the router in light bearing contact with the surface of the workpiece.

As shown in FIG. 2, the stop 59 is in the form of an internally threaded collar having a knurled outer surface 60 for gripping to turn the collar on an externally threaded section 61 of the body 39 of the stylus 10. In service use, the collar is threaded upwardly on the stylus until the upper surface 63 of the collar abuts the lower surface of the arm which, in the present instance, is shown as the lower end of a boss 64 housing the stylus bushing 41. Once in abutting engagement with the boss, the collar is turned slightly upward to relieve some of the weight of the router on the workpiece so that the router slides more freely over the surface of the workpiece. As the arm is being moved with the stylus tip 21 following in the groove 40 of the template 23, the collar may be turned to either raise or lower the arm to maintain the slide plate 34 of the router 15 in light bearing contact with the surface 35 of the workpiece 14 and, in this way, the router may be adjusted vertically to follow the surface and ride over any warped or raised portions of the surface without the router binding against the workpiece or the stylus being lifted from the template groove. Moreover, by keeping the slide plate in contact with the surface of the workpiece, the material cut from the workpiece is more easily vacuumed away without being thrown out from between the router and the workpiece to clutter the floor beneath the machine.

Under conditions, such as when cutting a uniform depth of groove 13, it may be desirable to lock the stop 57 in a certain axial position on the stylus body 39. To this end, a nut 65 may be threaded onto the threaded section 61 of the stylus body and into tight engagement with the stop collar 59 to lock the collar against turning. Usually, however, the nut is spaced downwardly from the collar to allow free turning of the collar on the body for adjusting the horizontal position of the arm 16.

From the foregoing, it will be appreciated that the present invention brings to the art a new and improved stylus 10 particularly adapted for use in a sign-making machine 11 for easier operation of the machine in producing signs. Advantageously, the stylus is mounted slidably within the free end portion 20 of the arm 16 of the machine for movement between projected and retracted positions relative to the underside 57 of the arm so that, when lowering the arm into its working position, the tip 21 of the stylus engages with the template 23 to locate the router bit 36 accurately relative to the workpiece 14 before cutting into the workpiece. In addition, the adjustable stop 59 enables the router to be raised or lowered easily during cutting so as to remain in light bearing contact with the surface 35 of the workpiece for easy movement of the arm while following the figures in the template.

I claim as my invention:

1. In a machine for making a sign by routing grooves in a workpiece, the combination of a frame, a template located on said frame along one side thereof, a clamp for securing the workpiece on the frame in a preselected position relative to said template, a guide rod secured to said frame opposite said template and extending in an x direction, a carrier slidably mounted on said guide rod for movement in said x direction, an arm slidably mounted on said carrier for movement therewith in said x direction and for movement relative to said carrier in a y direction, said arm also being pivotal relative to said rod for movement in a vertical direction between a raised position and a work position extending in a generally horizontal direction, a router secured to said arm intermediate the ends thereof and being movable in said *x* and *y* directions with said arm, said router having a slide plate for engagement with the surface of said workpiece and a bit extending downwardly beyond said plate for cutting a groove in said workpiece as said router is moved with said arm in said *x* and *y* directions when the arm is in its work position, the improvement in said machine comprising a stylus mounted within the outer end portion of said arm and having a lower tip engageable with said template to guide said router to produce a groove in said workpiece, said stylus tip being movable relative to said arm between first and second positions spaced from said arm, said tip in said first position being spaced from said arm to engage said template before said bit cuts into the workpiece as the arm is pivoted downwardly toward its work position thereby enabling said router to be aligned accurately with respect to said template before initial cutting of the groove, said stylus in its second position riding on the template with the arm in its work position to guide movement of the arm in said *x* and *y* directions, and means connected between said stylus and said arm for securing said stylus to said arm and for limiting movement of said tip between said first and second positions.

2. The combination defined by claim 1 including means operable during cutting of the groove for selectively changing the distance between said arm and said tip to move said arm vertically relative to said tip and thereby move said router vertically so said slide plate generally follows the contour of the surface of said workpiece.

3. The combination defined by claim 2 including a spring carried by said arm and urging said stylus into said first position.

4. The combination defined by claim 2 wherein said means for selectively changing the distance between said arm and said tip includes a stop secured to said stylus for selective movement in a generally axial direction along said stylus, said stop having a surface engageable with said arm to support said arm upwardly on said stylus whereby as said stop is moved in an axial direction on said stylus said arm is positioned selectively from the tip of said stylus.

5. The combination defined by claim 4 wherein said stop is an internally threaded collar telescoped onto said stylus, said stylus further including an externally threaded section formed thereon below said arm, said collar being threaded on said section with the upper end of said collar defining said surface and abutting the underside of said arm.

6. The combination defined by claim 5 further including a nut threaded onto said section below said collar for abutting engagement with said collar to lock the latter in a selected position from the tip of said stylus.

7. The combination defined by claim 3 wherein said means for securing said stylus to said arm includes a bracket with one end portion fastened to said arm and an opposite end portion slidably connected to said stylus, an axial bore formed in the upper end portion of said stylus, an elongated slot formed through said stylus and opening into said bore, said opposite end portion of said bracket extending through said slot and into said bore, said spring being telescoped into said bore beneath said bracket to urge said stylus downwardly with respect to said arm, and means preventing said stylus from sliding downwardly off said opposite end portion of said bracket.

8. A stylus adapted for mounting on the movable arm of a sign-making machine, said stylus including an elongated generally cylindrical body with a pointed tip at one end thereof, an axial bore formed in and opening from the opposite end portion of said body, said bore having a lower end spaced intermediate the opposite ends of said body, an elongated slot formed through the body and opening into said bore, said slot extending from said opposite end of said body in a generally axial direction toward the lower end of said bore, a coil spring telescoped into said bore, a connector having an inner end portion extending through said slot and into said bore to captivate said spring within said bore and being adapted to slide in an axial direction along said slot toward and away from the tip of said body, said connector having an outer end portion for fastening said stylus slidably through the arm whereby said spring acts between said arm and said stylus so as to urge said tip away from the underside of the arm, means connected to said opposite end portion of said body for blocking said connector against sliding out of said bore, an externally threaded section formed on said body intermediate the ends thereof, and an internally threaded collar mated with said threaded section to abut the underside of said arm for selective positioning of said arm relative to said tip when using said stylus on the machine.

9. In a sign-making machine having a frame, an arm pivotally mounted thereon for movement in a vertical direction between a raised position and a generally horizontal working position and also for sliding movement in *x* and *y* directions, a template supported on said frame, and a router carried by said arm and including a bit projecting downwardly therefrom to cut grooves in a workpiece corresponding to said template, the improvement in said machine comprising a stylus for guiding said arm to follow said template, said stylus having a body mounted slidably through said arm for movement between extended and retracted positions with respect to said arm, a spring acting between said arm and said stylus to urge the latter into its extended position to engage said template before said bit cuts into said workpiece as said arm is moved from its raised position into its working position, said stylus being slid upwardly relative to said arm and into said retracted position as said arm is lowered into its working position with said bit cutting into the workpiece, and an adjustable stop connected to said stylus and abutting the arm to support the latter against sliding downwardly on said stylus below a selected distance from the lower end of said stylus, said stop being movable vertically relative to the lower end of said stylus while cutting a groove in the workpiece to vary said selected distance and thereby move said arm vertically so as to adjust the vertical position of the router with respect to horizontal.

* * * * *